US009011647B2

(12) United States Patent
Lissianski et al.

(10) Patent No.: US 9,011,647 B2
(45) Date of Patent: Apr. 21, 2015

(54) PLASMA-ASSISTED TREATMENT OF COAL

(75) Inventors: Vitali Victor Lissianski, San Juan Capistrano, CA (US); Anthony Mark Thompson, Aliso Viejo, CA (US); Daniel Lawrence Derr, San Diego, CA (US); Gregg Anthony Deluga, Los Angeles, CA (US); Ramanathan Subramanian, Orange, CA (US); Surinder Prabhjot Singh, Tustin, CA (US)

(73) Assignee: General Electric Company, Niskayuna, NY (US)

( * ) Notice: Subject to any disclaimer, the term of this patent is extended or adjusted under 35 U.S.C. 154(b) by 1299 days.

(21) Appl. No.: 12/478,852

(22) Filed: Jun. 5, 2009

(65) Prior Publication Data

US 2010/0307960 A1 Dec. 9, 2010

(51) Int. Cl.
*C10G 1/00* (2006.01)

(52) U.S. Cl.
CPC ..... *C10G 1/00* (2013.01)

(58) Field of Classification Search
CPC ..... B01J 19/088; C10G 1/00
USPC ..... 208/402
See application file for complete search history.

(56) References Cited

U.S. PATENT DOCUMENTS

| | | | | |
|---|---|---|---|---|
| 4,010,089 | A * | 3/1977 | Stowell et al. | 204/168 |
| 4,283,583 | A * | 8/1981 | Velenyi et al. | 585/467 |
| 4,435,374 | A | 3/1984 | Helm | |
| 4,487,683 | A * | 12/1984 | Bozzuto | 585/534 |
| 4,822,940 | A * | 4/1989 | Leff et al. | 585/415 |
| 2005/0000163 | A1 | 1/2005 | Dalton | |
| 2005/0042168 | A1 | 2/2005 | Kruesi | |
| 2006/0107585 | A1 | 5/2006 | Gupta | |
| 2007/0186472 | A1 | 8/2007 | Rabovitser et al. | |
| 2007/0274893 | A1 | 11/2007 | Wright et al. | |
| 2008/0222956 | A1 | 9/2008 | Tsangaris et al. | |
| 2009/0064581 | A1 | 3/2009 | Nielsen et al. | |

OTHER PUBLICATIONS

K. Welch, "Valero Rides the Wind" in Amarillo Globe-News (Dec. 7, 2008), available at http://amarillo.com/stories/120708/bus_biz1.shtml.*

H. Conrads and M. Schmidt, Plasma Generation and Plasma Sources, 9 Plasma Sources Sci. Technol. 441-454 (2000).*

Kamei, O., Onoe, K., Marushima, W., and Yamaguchi, T. "Brown coal conversion by microwave plasma reactions under successive supply of methane". Fuel vol. 77, No. 13, pp. 1503-1506, 1908.

Sackinger, W. M. Obelisk Hydrocarbons (Alaska) Ltd. Kamath, V. A. Univ. Of Alaska Fairbanks. Plasma Conversion of Methane Into Higher Hydrocarbons at Surfaces. Coal Liquefaction and Gas Conversion Contractors Review Conference, 1995. Pittsburgh Energy Technology Center.

Onoe, K., A. Fujie, et al., "Selective synthesis of acetylene from methane by microwave plasma reactions." Fuel 76(3): 281-282, 1997.

Wang, X., A. Wang, et al., "Microwave Plasma Enhanced Reduction of SO2 to Sulfur with Carbon." Energy & Fuels 21 (2): 867-869, 2007.

Kanilo, P. M., V. I. Kazantsev, et al., "Microwave plasma combustion of coal." Fuel 82(2): 187-193, 2003.

Thanyachotpaiboon K., and Chavadej, S., Caldwell, T.A., Lobban, L.L., and R. G. Mallinson, R.G. "Conversion of Methane to Higher Hydrocarbons in AC Nonequilibrium Plasmas", AIChE Journal, Oct. 1998 vol. 44, No. 10, 2252-2257.

Gasner, L., Denloye, A., and Regan, T., "Microwave and Conventional Pyrolysis of a Bituminous Coal", Chemical Process Systems Laboratory, Research Report, The University of Maryland, 1986.

Horie Takashi, Kobayashi Motoki, Onoe Kaoru, Yamaguchi Tatsuaki, "Coal Decomposition by Microwave Plasma Technique-Effect of Plasma Source on Coal Conversion and Product Distribution", Nippon Enerugi Gakkai Sekitan Kagaku Kaigi Happyo Ronbunshu, vol. 37, pp. 369-372 (2000).

Vavriv, D.M. Kanilo, P.M. Kazantsev, V.I. Rasyuk, N.I. Schunemann, K., "Microwave plasma technology of coal ignition and combustion", Plasma Science, 2003. ICOPS 2003. IEEE Conference Record—Abstracts. The 30th International Conference, p. 448 (Jun. 2003).

* cited by examiner

*Primary Examiner* — Randy Boyer
(74) *Attorney, Agent, or Firm* — Joseph J. Christian

(57) ABSTRACT

A process for the plasma-assisted treatment of coal in which coal is directly converted to heavy hydrocarbons. The first step in the process is direct conversion of coal to aliphatic hydrocarbons under plasma conditions in the presence of light hydrocarbons, such as natural gas. In the second process step, the aliphatic hydrocarbons are upgraded to a liquid fuel. The energy for the process can be provided by radio frequency energy, such as microwave energy, that is powered by a renewable energy source. The process has flexibility to adjust aromatic content in the fuel to match fuel specification requirements.

12 Claims, 4 Drawing Sheets

PLASMA-ASSISTED TREATMENT OF COAL

BACKGROUND OF THE INVENTION

1. Field of the Invention

The invention is related to plasma-assisted, low temperature conversion of coal in the presence of a light hydrocarbon to produce liquid hydrocarbons that are subsequently upgraded to liquid transportation fuels. The fuel conversion can be designed to produce liquid transportation fuels in $CO_2$ neutral processes.

2. Description of the Related Art

A pyrolysis process is the low temperature heating of coal in the absence of an external supply of oxygen. The heating of coal causes devolatilization and produces a mixture of light gases, tar oils and char. Pyrolysis is usually carried out at low temperatures as compared to gasification to maximize the yield of tar oils. The pyrolysis liquids (called pyro-oils) composition depends on a number of factors such as temperature, residence time, pressure, heating rate, etc. The liquids generated from pyrolysis are generally low in quality and need considerable upgrading to remove aromatics and increase hydrogen composition.

Hydro-liquifaction is similar to pyrolysis process generating liquid fuels from coal. The hydro-liquifaction requires hydrogen as feed to this exothermic process. The drawback of this process is that the liquid yield is low and the liquids are high in aromatics and require significant upgrading to be sold as liquid transportation fuels. Also, natural gas reforming is done to produce hydrogen, which produces $CO_2$. The heat required for the reforming process is provided by burning the char. This further increases the production of $CO_2$.

Hydro-gasification is carried out at higher temperatures. This process has been developed specifically to make methane from coal at high temperatures. The process, if carried out at lower temperatures, can increase the yield to liquids. It suffers from the same disadvantages as pyrolysis and hydro-liquifaction in that the liquids created require significant upgrading and the hydrogen needed to upgrade the liquids creates excess $CO_2$ emissions.

All these approaches use combustion of valuable char as source heat. Thus, they all produce $CO_2$ from char combustion. In addition, $CO_2$ is produced in the reforming process by converting natural gas to hydrogen and $CO_2$. Therefore, it would be desirable to provide a process that does not require the combustion of char, is $CO_2$ free, the hydrogen required for fuel upgrade is provided by natural gas, and the energy required for the process is provided by a renewable energy.

BRIEF SUMMARY OF THE INVENTION

In one aspect of the invention, a process for the plasma-assisted treatment of coal is disclosed in which coal is directly converted to heavy hydrocarbons under plasma conditions in the presence of light hydrocarbons.

In another aspect of the invention, a process for converting coal to liquid fuel, comprising the steps of:

directly converting coal to heavy hydrocarbons under plasma conditions in the presence of light hydrocarbons; and converting the heavy hydrocarbons to a liquid fuel.

In yet another aspect of the invention, a process for converting coal to aliphatic hydrocarbons is disclosed, comprising steps of:

directly converting coal to oils using radio frequency energy; and hydrogenating oils by transferring hydrogen from light hydrocarbons under plasma conditions.

DETAILED DESCRIPTION OF THE INVENTION

In general, plasma assisted direct coal conversion is a process that uses microwave energy to produce aliphatic hydrocarbons from coal, while simultaneously upgrading liquids to increase their hydrogen content by reacting them with natural gas in the presence of plasma (i.e. ionized gas). Next, the aliphatic hydrocarbons are converted to liquid fuel after passing through catalytic cracking and distillation units. The process produces a variety of liquid fuels, including liquid propane gas (LPG), naphtha, gasoline, jet, diesel, fuel oil, light cycle oil fuels, and the like.

Figure 1:
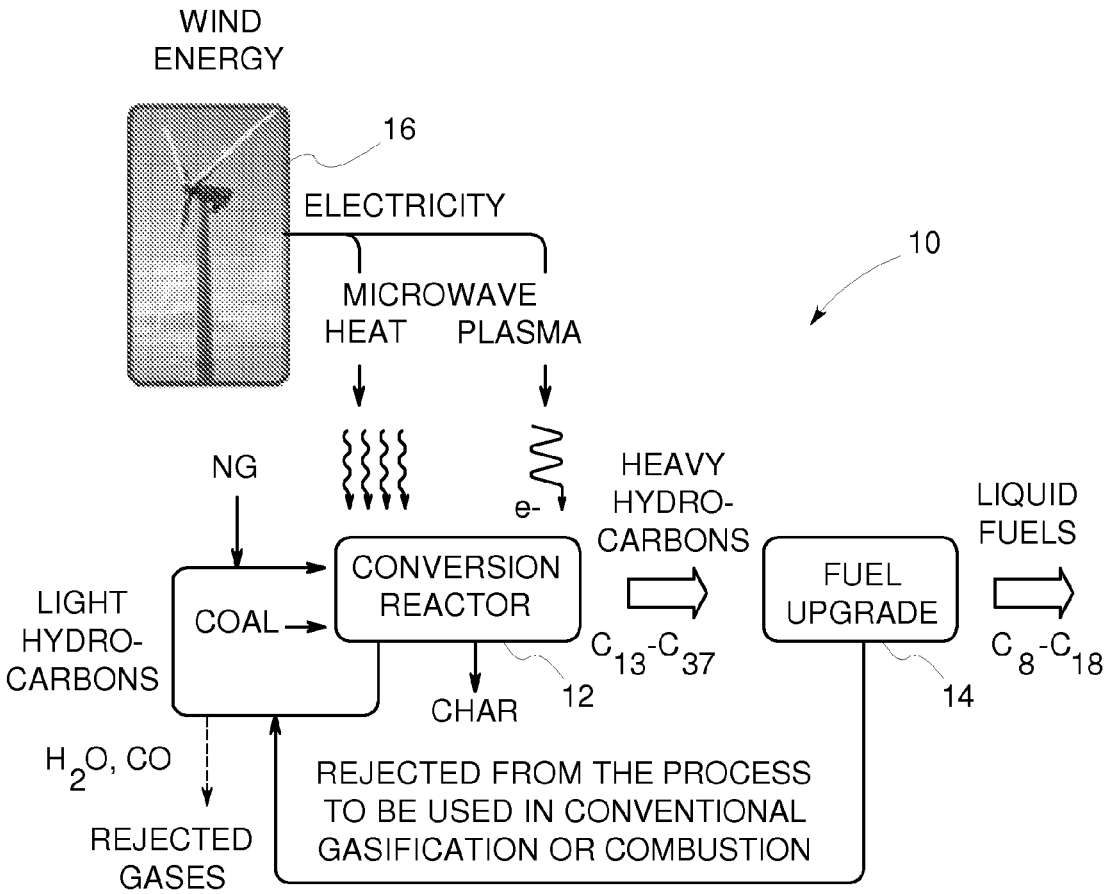
FIG. 1 is a process Block Flow Diagram (BFD) of the basic steps of a plasma assisted direct coal conversion process according to an embodiment of the invention.

Referring now to FIG. 1, a Block Flow Diagram (BFD) of a plasma-assisted direct coal conversion system is shown generally at 10 according to an embodiment of the invention. In general, the coal is introduced into a conversion reactor 12 to produce heavy hydrocarbons or aliphatic compounds, such as methane, and the like. The plasma-assisted direct conversion of coal to heavy hydrocarbons takes place under plasma conditions in the presence of light hydrocarbons, such as natural gas, and the like. Next, the heavy hydrocarbons are converted to liquid fuel by passing the heavy hydrocarbons through a fuel upgrade unit 14, such as a catalytic cracking and distillation unit. Radio frequency energy, such as microwave energy, and the like, is used by the conversion reactor 12 in two forms: 1) heat energy, and 2) plasma energy. The electricity needed to produce the radio frequency energy, such as microwave energy, can be provided by a renewable energy source 16, such as wind, solar, thermal, hydro, or other sources of renewable energy to provide a self-contained energy system that does not require energy from outside sources (i.e. is not connected to the "grid").

Figure 2:
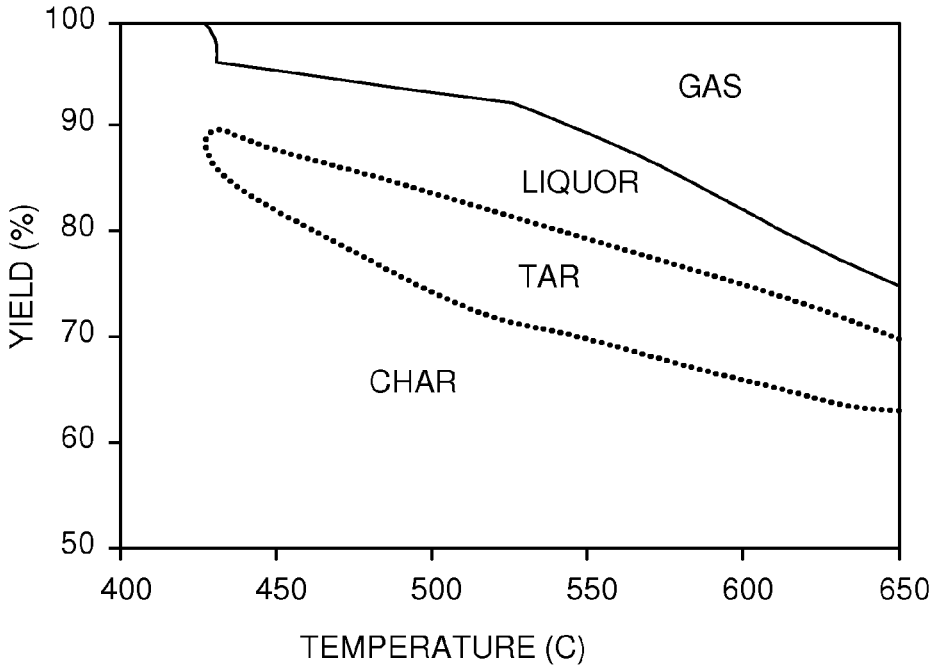
FIG. 2 is a graphical representation of a distribution of product from coal devolatilization in a typical direct coal conversion process at atmospheric pressure.

The first step in the process is plasma assisted direct conversion of coal to heavy hydrocarbons in the presence of light hydrocarbons. The distribution of coal devolatilization products in a typical direct coal conversion process at atmospheric pressure is shown in FIG. 2. It shows that yield of tar oils from coal is in the range of 10-15%. Tar oils produced by coal thermal cracking are mostly aromatic compounds with relatively low hydrogen content. In plasma assisted coal conversion, natural gas, which is 25% wt hydrogen, is used as the source of hydrogen. Microwave generated plasma is applied to assist in hydrogen transfer from methane (methane, main component of natural gas, is relatively un-reactive at 400-

600° C.). Microwave plasma generates ions and other active species, which lowers the temperature threshold for chemical reactions. In the case of plasma assisted direct coal liquefaction, the energy of plasma is used to remove hydrogen atoms from methane. By hydrogenating coal volatiles, the yield of heavy hydrocarbons can be increased to 25-30%. Gases that are produced during coal devolatilization contain light hydrocarbons which can be recycled to the reactor along with unreacted methane to decrease natural gas consumption. Devolatilization products also contain such light gases as CO and steam that can be separated from the recycle stream and rejected from the process. The CO can be used outside of the process to produce useful oxygenates such as methanol ($CH_3OH$) and formaldehyde ($CH_2O$).

Figure 3:
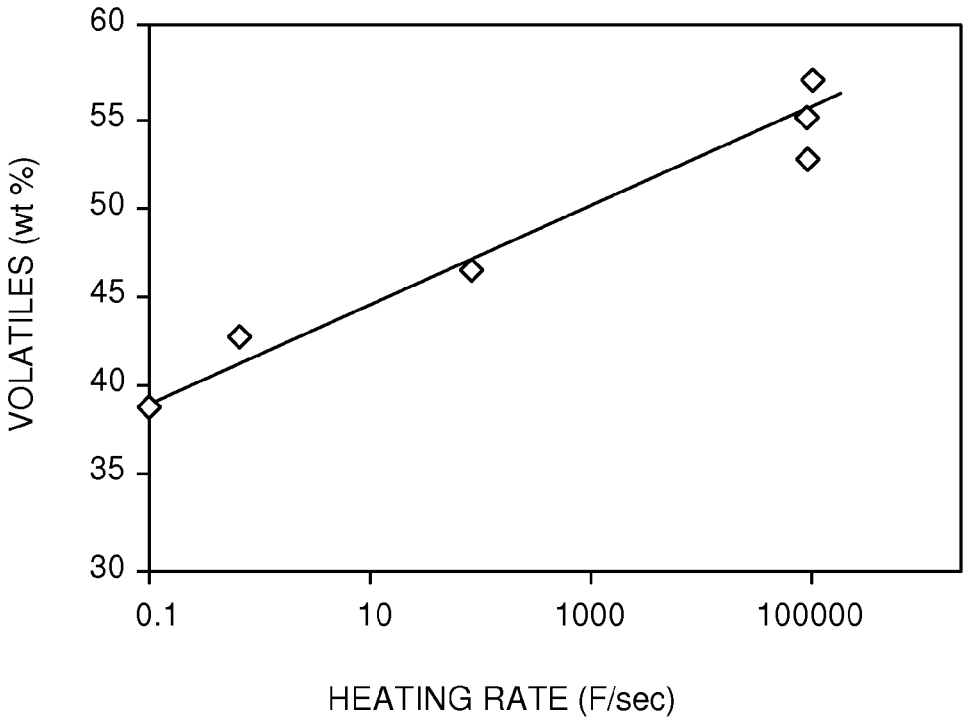
FIG. 3 is a graphical representation showing the effect of heating rate on the production of volatile matter.

Further increases in the yield of tar oils is achieved by high rates of coal heating by microwave followed by quick product cooling which slows secondary reactions that result in polymerization reaction increasing the tar yield. FIG. 3 shows that yield of volatile matter increases with increase in coal heating rate. At the relatively high heating rates in the process of the invention, the yield of tars can be expected to increase to 40-45%.

Radio frequency energy, such as microwave energy, is ideally suited to provide high heating rates. Microwave energy is transferred through the material electro-magnetically, not as a convective force or a radiative force. Therefore, the rate of heating is not limited by the surface transfer, and the uniformity of heat distribution is greatly improved. Heating times can be reduced to less than one percent of that required using conventional techniques.

Figure 4:
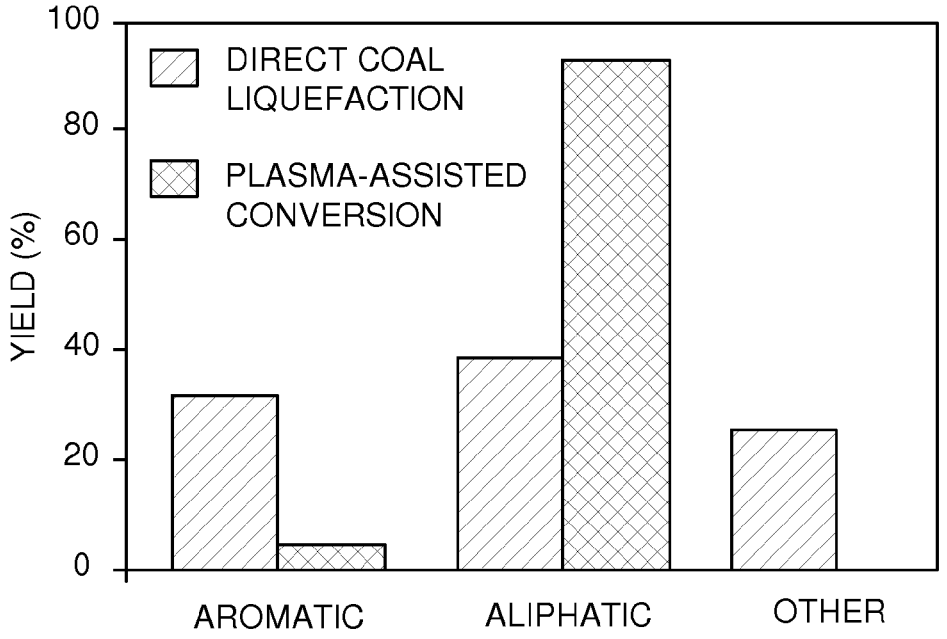
FIG. 4 is a graphical representation of a comparison of the composition of hydrocarbons produced in traditional direct coal liquefaction and plasma assisted processes.

The composition of coal tar oils produced in direct coal liquefaction has been studied for years and is well established. Coal tar oils have relatively high aromatics content with wide spectrum of species which complicates the fuel upgrade process. Hydrocarbons produced in plasma assisted coal conversion are expected to have very high content of aliphatic species. FIG. 4 compares compositions of hydrocarbons produced in traditional direct coal liquefaction and plasma assisted processes. The high yield of aliphatic hydrocarbons will increase the yield of liquid fuels and simplify the fuel upgrade process.

Previous data have suggested that hydrocarbons produced from coal under plasma conditions contain hydrocarbons with carbon numbers in the range of 13-34. In the upgrade process, hydrocarbons undergo catalytic cracking to reduce the number of carbon atoms to 9-18 which is a typical range for liquid fuels (gasoline is $C_9$, jet is $C_{14}$, and diesel fuel is $C_{16}$). The upgrade process may or may not require addition of hydrogen (if required, amount of hydrogen is anticipated to be relatively small). Hydrogen requirements for the cracking process will depend on how effective is the transfer of hydrogen from methane to hydrocarbons in the presence of plasma.

Process Mass and Energy Balances

The process BFD presented in FIG. 1 is used to establish process mass and energy balances. The process mass and energy balances are modeled for a bituminous coal. The following assumptions about the process are made:

- Hydrogen content is 6% wt in coal as received.
- Coal sulfur and oxygen content are 1% wt and 5% wt as received.
- Coal moisture content is 7% wt.
- Yield of heavy hydrocarbons from coal is 40% and light gases yield is 10%.
- Hydrogen content in heavy hydrocarbons is 15% wt.
- Yield of liquid fuels from heavy hydrocarbons is 95%. The rest of heavy hydrocarbons constitute light gases in the fuel upgrade process.
- Yield of JP-8 from liquid fuels in distillation is 20%.

Figure 5:
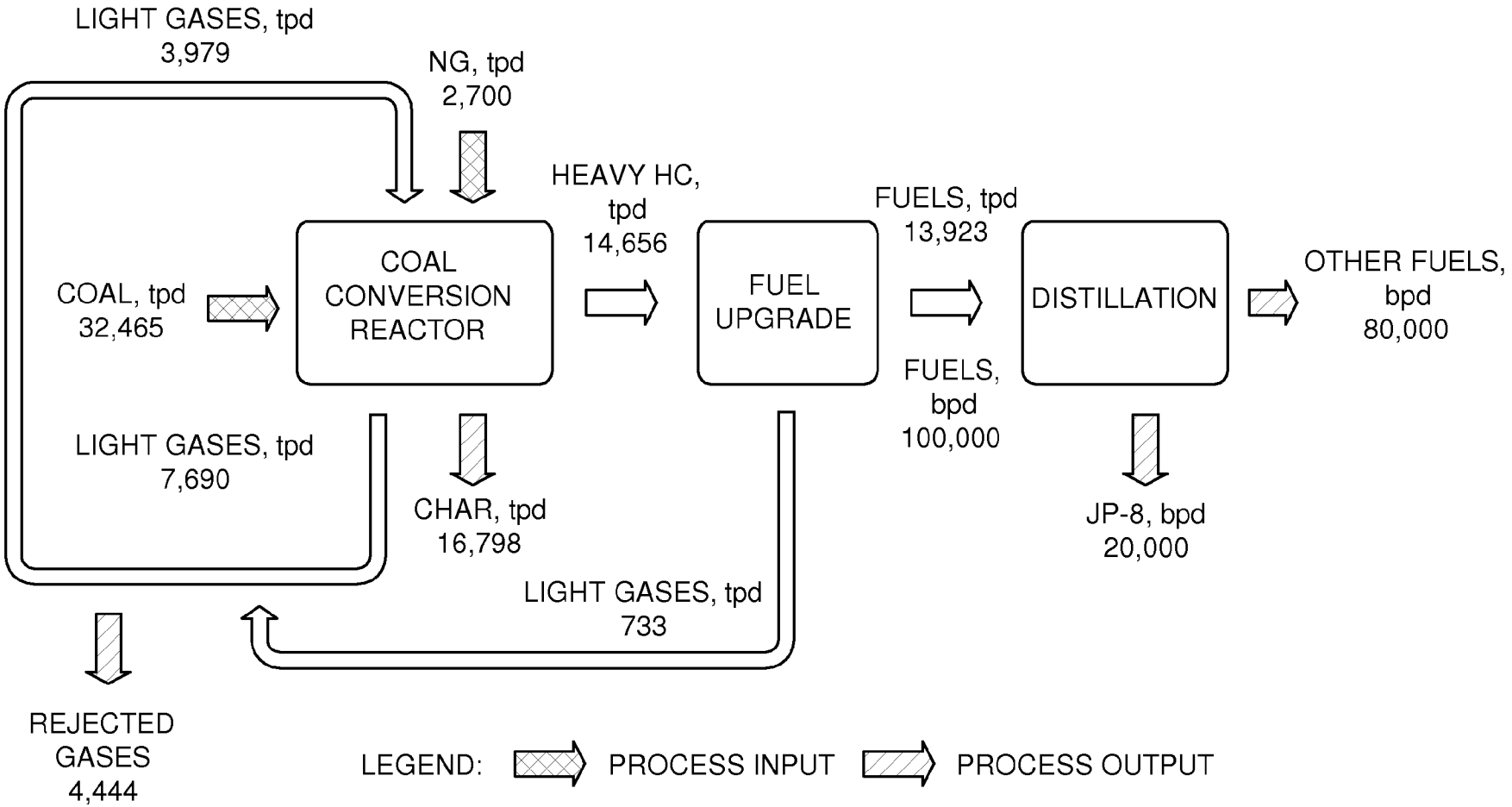
FIG. 5 is a schematic diagram showing mass flow using the process of FIG. 1 based on a target rate of total liquid fuel production of about 100,000 bpd.

FIG. 5 shows a process mass flow diagram based on the above assumptions and on the target rate of total liquid fuel production of about 100,000 bpd using the process of FIG. 1.

The overall yield of volatiles from coal under high heating rate conditions provided by microwave source is about 50%, most of which are heavy hydrocarbons. Light gases that are released from coal include light hydrocarbons, moisture, CO, and $H_2S$. Oxygen from coal is assumed to be released as CO and $H_2O$ (this is in addition to the moisture from coal). These light gases are shown in FIG. 5 as light gases coming out of the coal conversion reactor. The moisture, CO, and $H_2S$ are separated from the stream and rejected from the process. Moisture, which is the main component of the rejected gases, is condensed and can be used somewhere else. The CO and $H_2S$ can be used as a raw material for production of $CH_3OH$ and sulfur outside of the process.

Char produced in the conversion reactor is a combination of char from coal and soot. The char was assumed to contain 3% wt hydrogen. Natural gas in the process is used as a source of hydrogen to increase hydrogen content in heavy fuels to about 15% wt which is the typical hydrogen content in jet fuel. The natural gas consumption rate was adjusted to match hydrogen requirements for the process. Natural gas requirements are expected to be lower for low rank coals since they typically have higher hydrogen content. Thus, natural gas consumption has to be tailored to the coal type. It is possible that for some low rank coals natural gas requirements can be eliminated altogether. It has been demonstrated that about 90% of aliphatic hydrocarbons are converted to liquid fuel and about 10% are released from the process as light hydrocarbons. These hydrocarbons are shown in FIG. 5 as light gases coming out of the fuel upgrade reactor. They are recycled to the coal conversion reactor along with light hydrocarbons produced in the fuel conversion reactor.

In an example, the process uses about 32,465 tpd of coal to produce about 16,798 tpd of char and about 13,923 tpd of liquid fuels. The char can be used outside of the process in conventional combustion or gasification. About 8,423 tpd of light gases (mostly light hydrocarbons, CO and moisture) are also produced in the process. About 60% of these gases (about 3,979 tpd) can be recycled into the coal liquefaction reactor to be used as a source of hydrogen. The rest of the light gases are rejected from the process. The process produces about 20,000 bpd of JP-8 and about 80,000 bpd of other liquid fuels including gasoline and diesel.

Table I below shows an exemplary process mass balance. The overall amount of materials that input the process for a 100,000 bpd plant is about 35,165 tpd. The same amount of products is generated by the process of FIG. 1 in the form of liquid fuels, char and rejected light gases.

TABLE 1

Process mass balance.

| Process Inputs, tpd | | Process Outputs, tpd | |
|---|---|---|---|
| Coal | 32,465 | Char | 16,798 |
| NG | 2,700 | Liquid Fuel | 13,923 |
| | | Rejected gases | 4,444 |
| Total | 35,165 | Total | 35,165 |

Figure 6:
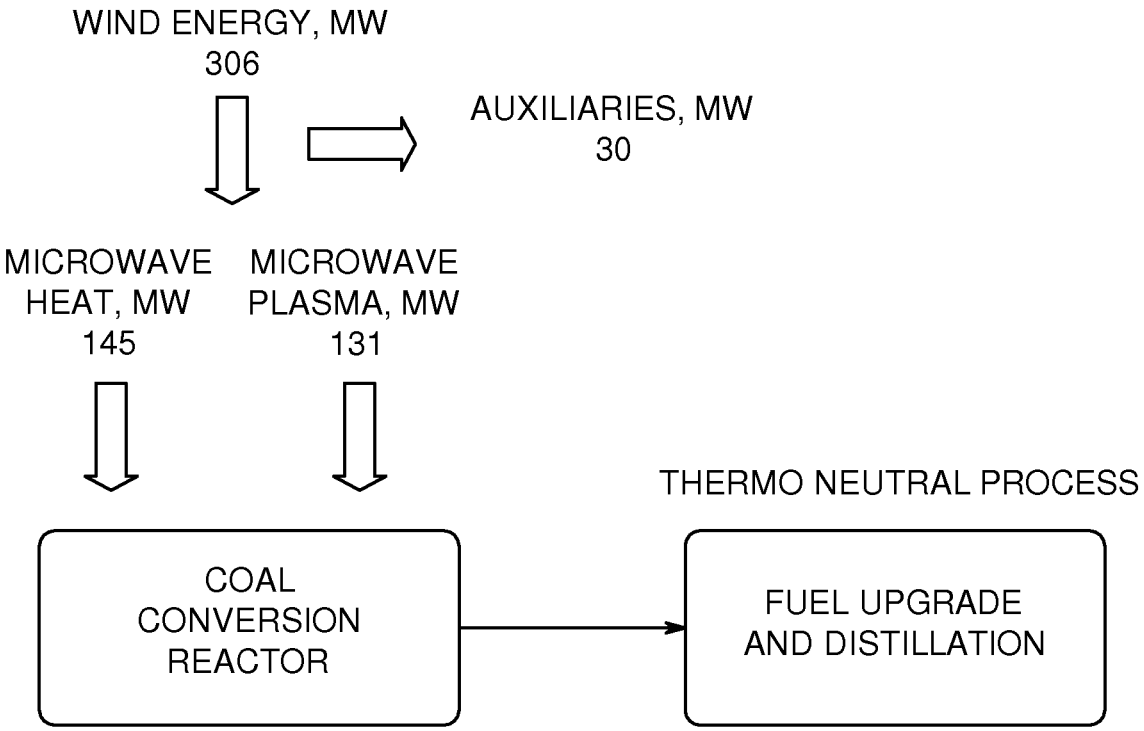
FIG. 6 is a schematic diagram showing energy balance using the process of FIG. 1 using two components of heat input to a coal conversion reactor.

Energy requirements for the process of FIG. 1 significantly contribute to the equipment capital and operational costs. FIG. 6 shows an exemplary process energy balance. Practically all energy requirements come from the first reactor in which coal is devolatilized and hydrogen content in heavy hydrocarbons increased to about 15%. Fuel upgrade and distillation processes are close to thermally neutral.

Two components of heat input to the conversion reactor 12 are thermal input to increase coal temperature to the devolatilization temperature and energy required to create plasma to increase reactivity of natural gas. Microwave energy is used to supply energy for both processes. Temperatures required for coal devolatilization depend on coal type and generally are in the range of about 450-550° C. with rate of devolatilization increasing with an increase in the temperature. Typically, yields of volatile matter are approximately 20% wt for low-volatile bituminous coals and about 50-55% for low-rank and high-volatile bituminous coals. As devolatilization temperatures increase, the yield of light gases also increases. Yield of heavy hydrocarbons is maximized at about 450-500° C. At these temperatures, the yield of light gases is minimized.

For the purpose of the process energy balance, it was assumed that temperature in the coal conversion reactor was about 500° C. and the specific heat of coal was about 0.24 Btu/lb-F. Microwave energy is one of the most effective methods to supply heat to the system 10. Assuming that energy efficiency of the microwave system is about 80%, it will take about 141 MW to raise the temperature of about 32,465 tpd of coal.

The second major energy requirement comes from plasma. The energy required to form plasma in a coal/gas mixture at atmospheric pressure is about 0.22 kWh/lb of coal. For the 32,465 tpd plant, this results in about 135 MW. Assuming that about 10% of total energy is used for auxiliaries, the overall energy requirements for the plant producing about 100,000 bpd of liquid fuel is about 306 MW.

Light hydrocarbons produced in coal conversion and fuel upgrade processes are recycled to reduce the natural gas requirements. Such light gases as CO and steam can be separated from the recycling stream and rejected from the process. The CO can be used outside of the process for various purposes, e.g., to produce useful oxygenates, such as methanol ($CH_3OH$) and formaldehyde ($CH_2O$). The char can be used outside of the process in conventional combustion or gasification.

Microwave energy plays an important role in the process: it supplies heat required to raise the coal temperature to 400-500° C. and forms plasma to assist in hydrogenation of heavy hydrocarbons and their conversion to aliphatic hydrocarbons. Because microwave energy is transferred through the material electro-magnetically, not as a thermal heat flux, the coal heating rate can be significantly increased, which results in a higher yield of tar and volatiles. The microwave plasma generates ions and other active species that lower the temperature threshold for chemical reactions, and assist in hydrogen transfer from methane to coal devolatilization products. The plasma assisted hydrogen transfer increases hydrogen content of heavy aromatic hydrocarbons (tar) and aliphatic compounds formed from them. The energy required for the process can be provided by $CO_2$-free wind turbines or other sources of renewable energy.

Microwave heat can result in higher heating rates of coal in comparison with traditional convective heating, therefore increasing the yield of volatile matter from coal. First, microwaves allow the coal to be heated in a rapid fashion. Microwave plasma also generates ions and other active species. In the presence of hydrogen-rich methane, which is otherwise relatively un-reactive at coal devolatilization temperatures, reactions of hydrogen-lean hydrocarbons produced from coal and hydrogen rich methane proceed. Therefore, an increase in the yield of aliphatic hydrocarbons from coal can be a beneficial result, as compared to conventional direct CTL technologies.

In the process shown in FIG. 1, microwave energy is also used to generate plasma to assist in hydrogen transfer from methane to heavy hydrocarbons. This plasma is generated in a different section of the reactor when microwave energy density exceeds critical levels. A higher ionization ratio and plasma density can be obtained in microwave plasma, in comparison with other plasma generating techniques.

The energy required to transform coal and maintain plasma conditions can be provided by $CO_2$ free renewable energy from a self-contained system. Depending on location, it can be hydro, thermal, solar, or wind energy.

As described above, the plasma assisted coal conversion process of the invention is a novel process for direct conversion of coal to liquid fuels. It is based on a solid scientific foundation and utilizes microwave plasma to enhance the yield of liquid fuels and their hydrogen content. In recent years with the development of the microwave technology, advantages of applying microwave plasma to industrial processes have been recognized. Some of such applications include improving of coal quality, destruction of tars in syngas produced by coal and biomass gasification, volatile organic compounds destruction, drilling of ceramic materials, and others.

In the invention, microwave energy is used for two purposes: 1) providing fast coal heating rates to increase the yield of hydrocarbons, and 2) forming plasma to accelerate reactions that transfer hydrogen from methane to hydrocarbons. While direct coal liquefaction and hydrocarbonization for liquid fuel production is a known process, the application of plasma is a novel approach.

Another novelty of the process of the invention is the high yield of aliphatic compounds from coal. Fuel upgrade in the conventional direct coal liquefaction process is very complicated due to wide range of species present, and due to the high aromatic content of coal tar oils. Fuel upgrading in the proposed process is less complicated due to the high content of aliphatic compounds in hydrocarbons expected at plasma assisted conditions.

The technology of the invention has clear advantages over existing direct coal to liquid (CTL) technologies. Liquid fuels produced in the process of the invention during coal conversion have high aliphatic content that simplifies the fuel upgrade process. The technology of the invention produces high quality liquid fuels at lower cost than existing technologies. It is also $CO_2$-free and does not require water. Because coal conversion takes place at relatively low temperatures, the process has lower capital cost requirements and can produce liquid fuels at lower cost.

The process shown in FIG. 1 can be applied to any coal type but is especially beneficial for low rank coals. Low rank coals have relatively high hydrogen content which is beneficial for the process. Many areas where Powder River Basin (PRB) coals are mined (for example, the state of Wyoming) have limited water resources. The proposed process has zero water requirements and is ideally suited for such areas. The Powder River Basin also has ample natural gas resources. The process generates high heating value char from a low rank coal. The char that is generated can replace coal in conventional combustion and IGCC plants. The process can be conducted at the mine mouth with energy produced locally from $CO_2$ free wind power. The liquid and solid products can be transported effectively by rail, more efficiently than current PRB.

In summary, the innovative features of the proposed technology include: (1) the utilization of microwave energy for rapid coal devolatilization, and to increase the yield of heavy aromatic hydrocarbons (tar) followed by their conversion to aliphatic hydrocarbons, (2) the recycling of light hydrocarbons into the process; and (3) the use of microwave plasma to accelerate reactions between natural gas, recycled light hydrocarbons and heavy aliphatic hydrocarbons, to produce a hydrogen-enriched feedstock for subsequent upgrading to liquids fuels.

The high yield of aliphatic compounds from coal is a significant improvement over existing direct coal conversion technologies. Fuel upgrading in the conventional direct coal liquefaction process is very complicated due to the wide range of species present, and due to the high aromatic content of tar oils. Fuel upgrading by way of the process of this invention is less complicated due to high content of aliphatic compounds in heavy hydrocarbons.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A process for the plasma-assisted treatment of coal, comprising: directly converting coal to heavy hydrocarbons under plasma conditions in the presence of light hydrocarbons, wherein the plasma conditions are created using radio frequency energy.

2. The process of claim 1, wherein the light hydrocarbons comprise natural gas.

3. The process of claim 1, wherein the radio frequency energy comprises microwave energy.

4. The process of claim 3, wherein the microwave energy receives electrical power from a renewable energy source.

5. A process for converting coal to liquid fuel, comprising the steps of:

directly converting coal to heavy hydrocarbons under plasma conditions in the presence of light hydrocarbons; and converting the heavy hydrocarbons to a liquid fuel, wherein the plasma conditions are created using radio frequency energy.

6. The process of claim 5, wherein the light hydrocarbons comprise natural gas.

7. The process of claim 5, wherein the radio frequency energy comprises microwave energy.

8. The process of claim 7, wherein the microwave energy receives electrical power from a renewable energy source.

9. A process for converting coal to aliphatic hydrocarbons, comprising the steps of:

directly converting coal to oils using microwave energy; and hydrogenating the oils in the presence of hydrogen from light hydrocarbons under plasma conditions.

10. The process of claim 9, further including the step of upgrading aliphatic hydrocarbons to a liquid fuel.

11. The process of claim 9, wherein the light hydrocarbons comprise natural gas.

12. The process of claim 9, wherein the radio frequency energy receives electrical power from a renewable energy source.

* * * * *